US006804867B2

(12) United States Patent
Oda et al.

(10) Patent No.: US 6,804,867 B2
(45) Date of Patent: Oct. 19, 2004

(54) PULL OF SLIDER FOR SLIDE FASTENER

(75) Inventors: Kiyoshi Oda, Toyama-ken (JP); Morimasa Yoneoka, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 10/247,420

(22) Filed: Sep. 18, 2002

(65) Prior Publication Data

US 2003/0079317 A1 May 1, 2003

(30) Foreign Application Priority Data

Oct. 25, 2001 (JP) ..... 2001-327880

(51) Int. Cl.[7] ..... A44B 19/26
(52) U.S. Cl. ..... 24/429; 24/431
(58) Field of Search ..... 24/419, 429, 431, 24/421

(56) References Cited

U.S. PATENT DOCUMENTS 4,368,562 A * 1/1983 Minami ..... 24/431 X
4,389,758 A * 6/1983 Akashi ..... 24/429
4,512,064 A 4/1985 Nishikawa
4,873,750 A * 10/1989 Tracy ..... 24/429
4,920,615 A * 5/1990 Aoki et al. ..... 24/429
4,974,297 A * 12/1990 Akashi ..... 24/429

FOREIGN PATENT DOCUMENTS

| | | |
|---|---|---|
| CH | 304015 | 12/1954 |
| FR | 2 457 083 | 12/1980 |
| JP | 64-43707 | 3/1989 |

* cited by examiner

*Primary Examiner*—Robert J. Sandy
(74) *Attorney, Agent, or Firm*—Bell, Boyd & Lloyd LLC

(57) ABSTRACT

A pull attachment portion is provided on a slider body integrally and a pull connecting ring has attachment plates integrally. A slit is formed in a center of the pull connecting ring and the attachment plates and provided with engaging portions on both sides of the slit, and free end portions of the engaging portions are protruded from the attachment plates. A through hole is provided in a face of an accommodating portion provided in an end of a pull main body for accommodating the attachment plate so as to form a holding portion. After deforming the attachment plates elastically in vertical directions through the slit and passing one of them through the pull attachment portion, the attachment plates are accommodated in the accommodating portion and fixed therein. Replacement of the pull is carried out by pressing the engaging portions through the through hole and removing them.

11 Claims, 7 Drawing Sheets

PULL OF SLIDER FOR SLIDE FASTENER

BACKGROUND OF THE INVENTION

1. Field of the Invention

The present invention relates to a pull of a slider for a slide fastener and more particularly to a pull of a slider for a slider, in which the pull is post-installed such that the pull may be attached to or removed from the slider body.

2. Description of the Related Art

Conventionally, there have been pulls having beautiful ornament or special mark or character, and these pulls have been attached to a slider body so as to meet customer's demand. For example, there is prepared a slider having a gap which allows a pull to be inserted between its slider body and pull attachment portion and then, a pull specified by a customer demands is inserted through the gap and attached to the slider body. Then, the gap is sealed by deforming the pull attachment portion plastically. Because the pull attachment portion is of cantilever type in this kind of the slider, if an excessive force is applied to the pull, the pull attachment portion is expanded and deformed so that the pull slips out.

To solve the above problem, it is preferable to form the pull attachment portion and the body integrally without providing any gap between them. Thus, a slider which allows the pull to be post-installed to the slider body 1" having no gap between the pull attachment portion 3" and the body 1", as shown in FIG. 8, is disclosed in Japanese Utility Model Application Laid-Open No. 64-43707.

In the slider for the slide fastener shown in FIG. 8 described above, the pull is attached to the slider body 1" using a damper 4". This damper 4" is formed of elastic material and the damper 4" has a slit 7", with which the ring-like attachment portion 5" of the pull may be inserted in the pull attachment portion 3" of the slider body 1". After the damper 4" is inserted into the pull attachment portion 3" by deforming the damper 4" elastically to expand a gap of the slit 7", the ring-like attachment portion 5" of the pull is installed by expanding the gap of the slit 7" and then, when the slit 7" is restored to its original state elastically, connecting of the slider body 1" and the pull is achieved. According to the slider having the above-mentioned configuration, when the pull is pulled or twisted, the damper 4" is deformed easily, so that the slit 7" is expanded and then the pull may sometimes slip out of the damper 4".

SUMMARY OF THE INVENTION

The invention has been achieved in consideration of the above-described problems and the point of the invention is that a pull is comprised of a pull main body and a connecting body, which are separate. After the connecting body is attached to a pull attachment portion of a slider body, the pull may be attached to the pull attachment portion by post-installation with accommodating and fixing the connecting body into the pull main body.

Thus, a main object of the invention is to provide a pull of a slider for a slide fastener in which the pull attachment portion of the slider is fixed completely to the slider body, wherein when the pull is connected by post-installation operation, the connecting body for connecting the pull with the body is deformed elastically so that the pull can be attached to the body easily, the pull can be replaced freely, and the connecting body is accommodated in and fixed to the pull main body thereby bearing a long term use.

Another object of the invention is to provide a pull of a slider for a slide fastener, in which the connecting body and the pull main body can be fastened and fixed to each other effectively by specifying a configuration of an engaging portion.

Further object of the invention is to provide a pull of a slider for a slide fastener, in which the connecting body is fastened and fixed to the pull main body easily and effectively by specifying a configuration of the holding portion.

Still another object of the invention is to provide a pull of a slider for a slide fastener, in which effective fastening function is exerted by specifying a configuration of the slit.

Further object of the invention is to provide a pull of a slider for a slide fastener, in which the connecting body and the pull main body can be connected with each other in a stabilized condition without any play thereby bearing long term use.

To achieve the above-described objects, according to the invention, in the slider for a slide fastener, the pull is comprised of the connecting body and the pull main body, the connecting body has the pull connecting ring with the attachment plate formed integrally with a part of the pull connecting ring and the slit is provided so as to communicate with the pull connecting ring and the attachment plate and divide the attachment plate. Further, the engaging portion capable of engaging the pull main body is provided on the attachment plate such that its front end is bent, the pull main body contains the accommodating portion capable of accommodating the attachment plate, provided on a side in which it is connected to the attachment plate, and the holding portion capable of holding the engaging portion provided on the attachment plate is provided in the accommodating portion. Thus, the attachment plate of the connecting body can be connected with the pull main body integrally. Consequently, when attaching the pull to the pull attachment portion fixed to the body by post-installation operation, the right and left attachment plates provided on the pull connecting ring can be deformed elastically in opposite directions easily. As a result, the connecting body can be attached to the pull attachment portion easily. Further, because the engaging portion provided on the attachment plate is inserted into and held by the accommodating portion in the pull main body, the connecting body and the pull main body are never separated easily from each other by such external force as tension or twisting.

Preferably, the engaging portion each provided on the attachment plate of the connecting body, which are engaged with the accommodating portion, are disposed on both sides of the slit provided in the attachment plate, such that they are protruded from a face or both faces of the attachment plate. Alternately, the engaging portion each provided on the attachment plate of the connecting body, which are engaged with the accommodating portion, are disposed on both side edges of the attachment plate, such that they are protruded from a face or both faces of the attachment plate. Consequently, the engaging portion, which is a mechanism for engaging the connecting body and the pull main body, can be formed on the attachment plate with a simple structure and hold the connecting body and the pull main body securely.

Preferably, the holding portion for holding the engaging portion of the attachment plate provided on the pull main body has a through hole or a concave groove communicating with the accommodating portion. Consequently, the holding portion, which is a mechanism for engaging the connecting body and the pull main body, can be formed in the accommodating portion with a very simple structure and achieve a secure holding.

Further preferably, the slit provided in the attachment plate of the connecting body is formed in a center of the attachment plate. Consequently, a space for disposing the engaging portion on each of both sides of the slit can be secured sufficiently, so that the connecting body and the pull main body can be connected with each other firmly.

Preferably, the accommodating portion provided in the pull main body for accommodating the attachment plate contains a protrusion, into which the slit provided in the attachment plate can be fitted, on a bottom of the accommodating portion. Consequently, the pull connecting ring and the pull main body can be connected with each other in a stable condition without any play.

DESCRIPTION OF THE PREFERRED EMBODIMENTS

Figure 1:
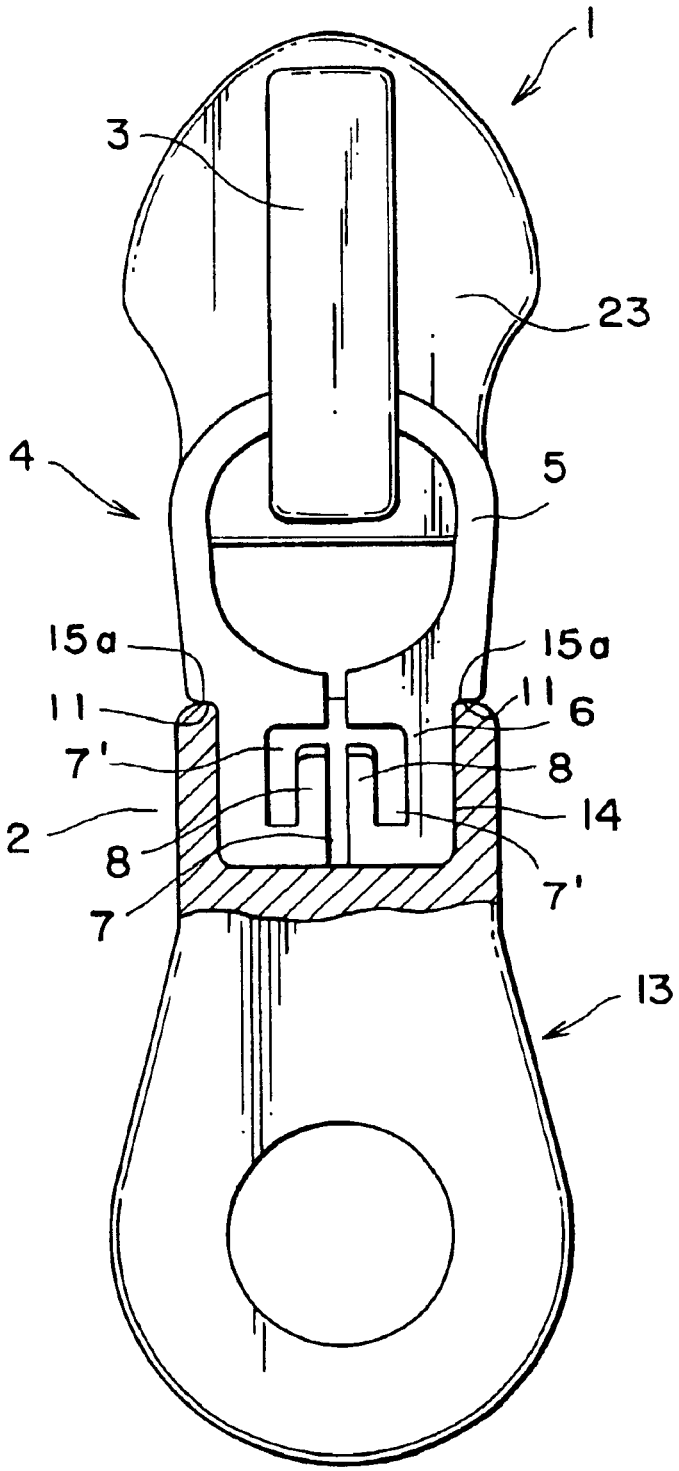
FIG. 1 is a partially broken front view of a slider having a pull of a slider for a slide fastener.

Hereinafter, the preferred embodiments of a pull of a slider for a slide fastener of the invention will be described in detail with reference to the accompanying drawings.

In a pull of a slider for a slide fastener of the invention, both ends of a mounting lever of a pull attachment portion 3 are fixed to a top face of an upper plate 23 of a slider body 1 and the pull 2 formed by connecting a connecting body 4 and a pull main body 13 is attached to the pull attachment portion 3. Thus, the pull 2 may be attached to the pull attachment portion 3 formed integrally on the body 1 of the slider by post-installation operation.

Figure 2:
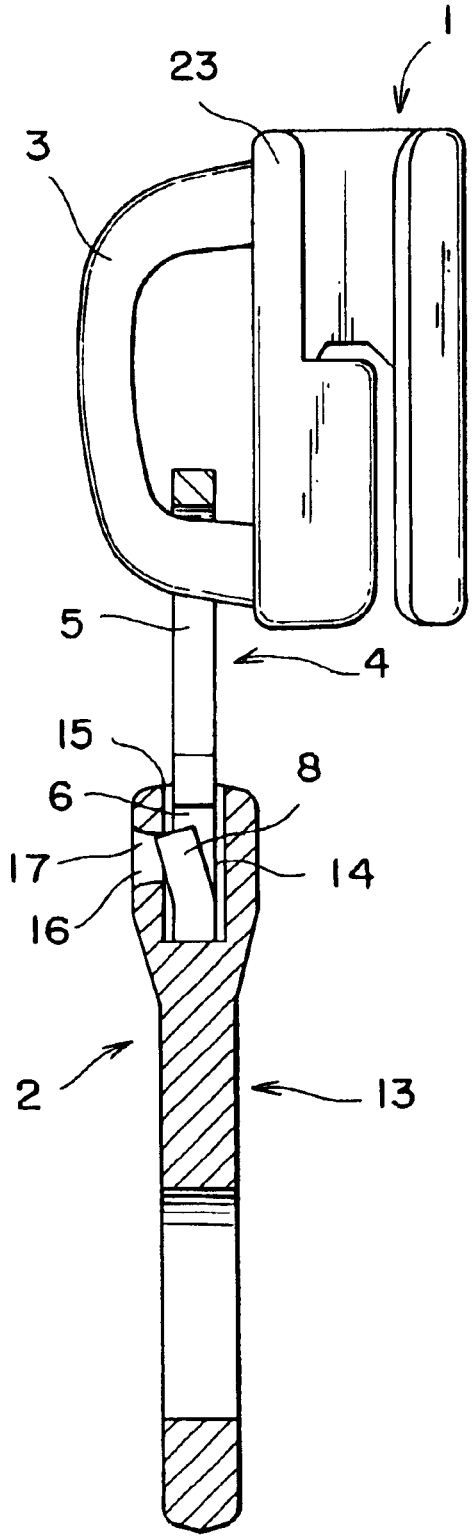
FIG. 2 is a partially broken side view of the slider having the same pull.
Figure 3:
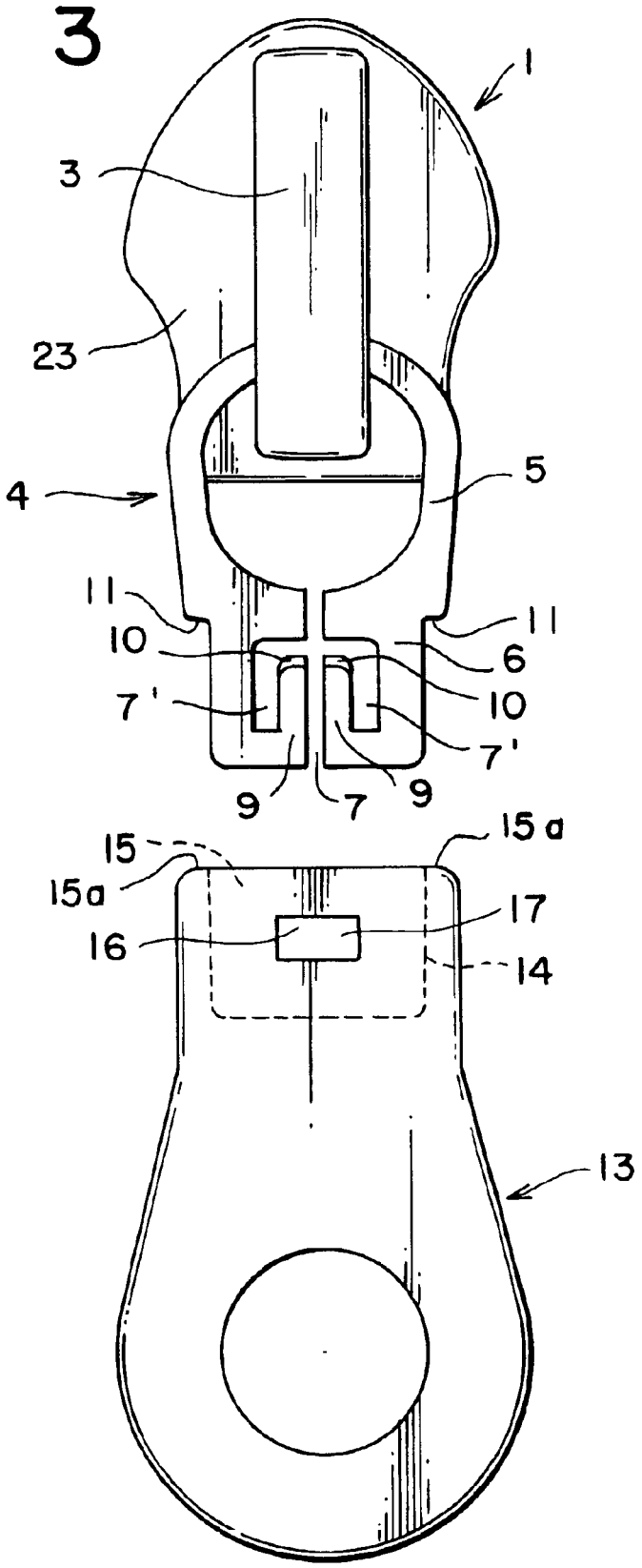
FIG. 3 is an exploded front view of the slider having the same pull.
Figure 4:
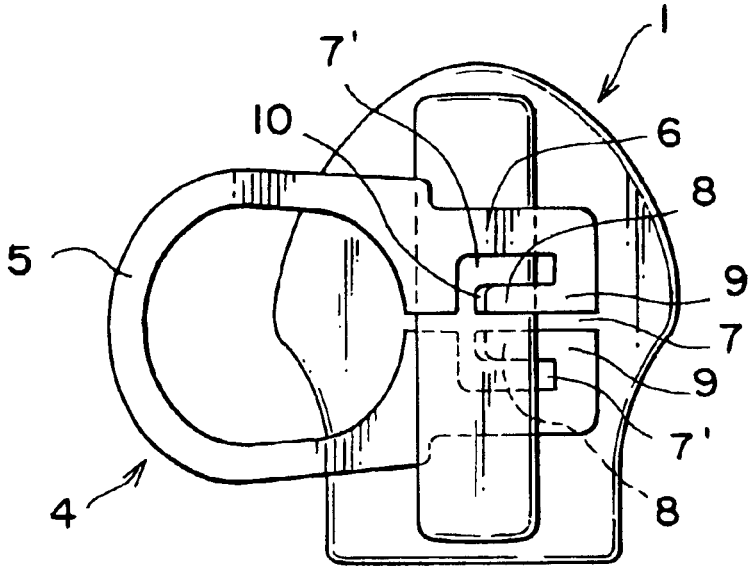
FIG. 4 is a front view showing a state in which a connecting body is attached to a body in the slider having the pull.

According to the first embodiment of a slider shown in FIGS. 1 to 4, the connecting body 4 is used to attach the pull main body 13 to the pull attachment portion 3 of the slider body 1. In the connecting body 4, an attachment plate 6 is provided integrally on one side of a ring-like pull connecting ring 5 and a straight slit 7 is made in a center of the attachment plate 6 from the pull connecting ring 5. Engaging portions 8 are provided at both sides of the slit 7. The engaging portions 8 are engaging lingulated pieces 8, each of which extends from a tip side of the attachment plate 6 toward a pull connecting ring 5 side. By providing hook-like slits 7' being continuous to the slit 7, engaging lingulated pieces 8 are formed on both sides of the slit 7. A base portion 9 of each of the engaging lingulated pieces 8 is connected to the attachment plate 6 and a free end portion 10 is formed at its front end such that it is flexible and deformable. The free end portion 10 is provided such that it is bent as if it is protruded from a surface of the attachment plate 6 as shown in FIG. 2. Stepped portions 11 are formed on both side edges of the attachment plate 6 as a guide face which facilitates connection between the attachment plate 6 and the pull main body 13. It is preferable to form the connecting body 4 by pressing a steel plate, because it is convenient to provide it with elasticity.

The pull main body 13, which is to be connected with the attachment plate 6 of the connecting body 4, is so formed that its side to be connected to the connecting body 4 is thicker as shown in FIG. 2. An opening 15, which substantially coincides with a sectional shape of the attachment plate 6, is provided in this thicker portion and then, a rectangular accommodating portion 14 enough deep to accommodate the attachment plate 6 up to its stepped portions 11 is formed. The stepped portions 11 oppose with side edge portions 15*a* of the opening 15 when the attachment plate 6 is accommodated in the accommodating portion 14. The stepped portions 11 and the side edge portions 15*a* are contacted or opposed each other with a little gap. A square through hole 17 is made in any one of front and rear faces of this accommodating portion 14 and a holding portion 16 capable of holding the free end portion 10 of the engaging lingulated piece 8 in a bent condition, when the attachment plate 6 is accommodated in the through hole 17, is formed in the attachment plate 6. The pull main body 13 can be formed in various types by die-casting with metal such as zinc alloy, conveniently, so that the beautiful pull 2 can be finished.

For assembling the pull 2, first, the connecting body 4 is mounted to the pull attachment portion 3 of the slider body 1 by displacing the connecting body 4 in opposite directions via the slit 7 in the attachment plate 6 of the connecting body, for example, such that one attachment plate 6 and the other attachment plate 6 are deflected in up and down directions by elastic deformation. Consequently, the ring-like pull connecting ring 5 of the connecting body 4 is attached to the pull attachment portion 3. Next, the pull main body 13 is connected with the connecting body 4 attached to the pull attachment portion 3. At the time, the attachment plate 6 is inserted into the accommodating portion 14 through the opening 15 such that the free end portion 10 of the engaging lingulated piece 8 provided in a bent condition on the attachment plate 6 corresponds to the holding portion 16 in the through hole 17. If the free end portion 10 of the engaging lingulated piece 8 is held by the holding portion 16, the connecting body 4 is connected with the pull main body 13 so that the pull 2 is mounted on the slider body 1.

If it is intended to replace the pull main body 13 engaged with the attachment plate 6 of the connecting body 4 or the connecting body 4 attached to the pull attachment portion 3, the engaging lingulated piece 8 may be pressed through the through hole 17 and retreated from the through hole 17, thereby making it possible for the attachment plate 6 to escape from the accommodating portion 14 of the pull main body 13 easily. Further, if it is intended to remove the connecting body 4 from the pull attachment portion 3, the attachment plates 6 of the connecting body 4 from which the pull main body 13 is removed may be pressed in opposite vertical directions by using the slit 7 with the elastic deformation and then, removed from the pull attachment portion 3. Consequently, the pull 2 can be replaced easily.

It is permissible to bend the engaging lingulated pieces 8 provided on the attachment plate 6 of the connecting body 4 in opposite vertical directions on both sides of the slit 7 and to form the through holes 17 in both vertical faces of the accommodating portion 14 serving as the holding portions 16 formed in the accommodating portion 14 of the pull main body 13, so that the holding portions 16 hold the engaging lingulated pieces 8. Further, it is permissible to form a concave groove 18 in a holding portion 16 instead of the through hole 17.

Figure 5:
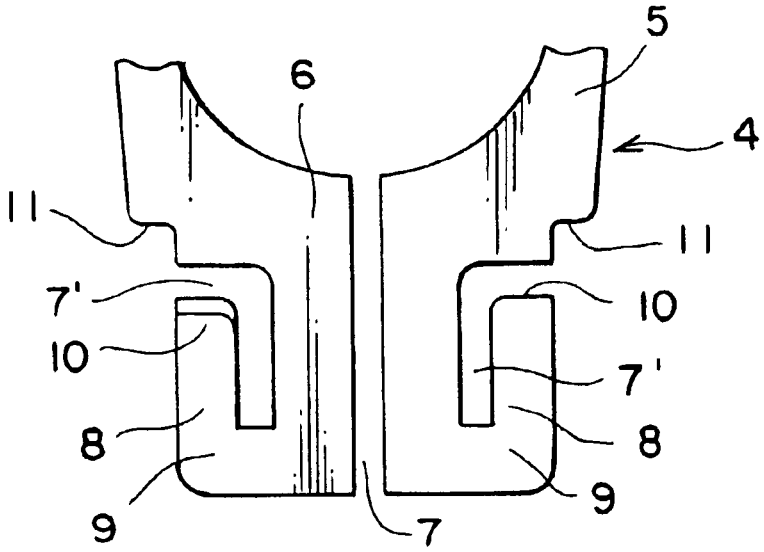
FIG. 5 is a front view showing a modification of the connecting body of the slider having the same pull.
Figure 6:
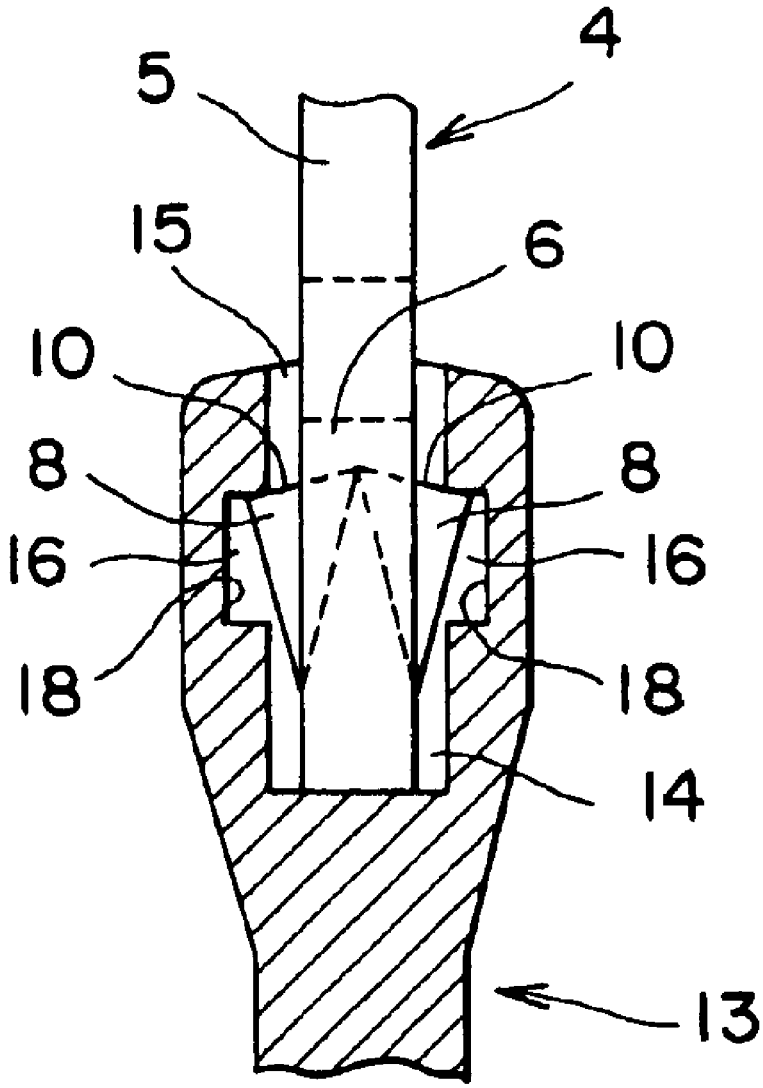
FIG. 6 is a partially broken side view showing a modification of a pull main body in the slider having the same pull.

The second embodiment shown in FIGS. 5 and 6 indicates a modification of a connecting mechanism between the pull connecting ring 5 and the pull main body 13. The engaging lingulated pieces 8, which should be provided on the attachment plate 6 of the pull connecting ring 5, are provided on both outside edges of the attachment plate 6 and for example, by providing the side edge of the attachment plate 6 with a hook-like slit 7', the engaging lingulated piece 8 is formed such that the base portion 9 of the engaging lingulated piece 8 is connected to the attachment plate 6. The free end portions 10 formed on a contrary end to the base portions in the engaging lingulated pieces 8 are bent respectively such that each of the free end portions is protruded in one of opposite vertical directions.

The accommodating portion 14 formed in the pull main body 13 has the opening 15, into which the attachment plate 6 can be inserted, provided on a side for connecting the pull connecting ring 5. The depth of the opening is formed such that up to the stepped portion 11 of the attachment plate 6 can be accommodated and the concave groove 18 is provided in the entire width of each of the top and lower faces of the accommodating portion 14 which the engaging lingulated piece 8 makes contact with when the attachment plate 6 is accommodated, so as to form the holding portion 16 capable of holding the free end portion 10 of the engaging lingulated piece 8. In the meantime, the pull main body 13 is formed by die-casting with zinc alloy like the above-described embodiment.

When assembling the pull 2, the attachment plate 6 of the connecting body 4 is inserted into the accommodating portion 14 formed in the pull main body 13, so that the free end portion 10 of the engaging lingulated piece 8 is held by the holding portion 16 of the concave groove 18 and fixed there. Consequently, the pull 2 is completed.

Meanwhile, it is permissible to bend the engaging lingulated pieces 8 provided on the attachment plate 6 of the connecting body 4 in the same direction at the right and left of the slit 7 so as to be held by the holding portion 16 of the concave groove 18 formed on one face of the accommodating portion 14. Further, the through hole 17 may be provided instead of the concave groove 18 so that the engaging lingulated piece 8 is held thereby.

Figure 7:
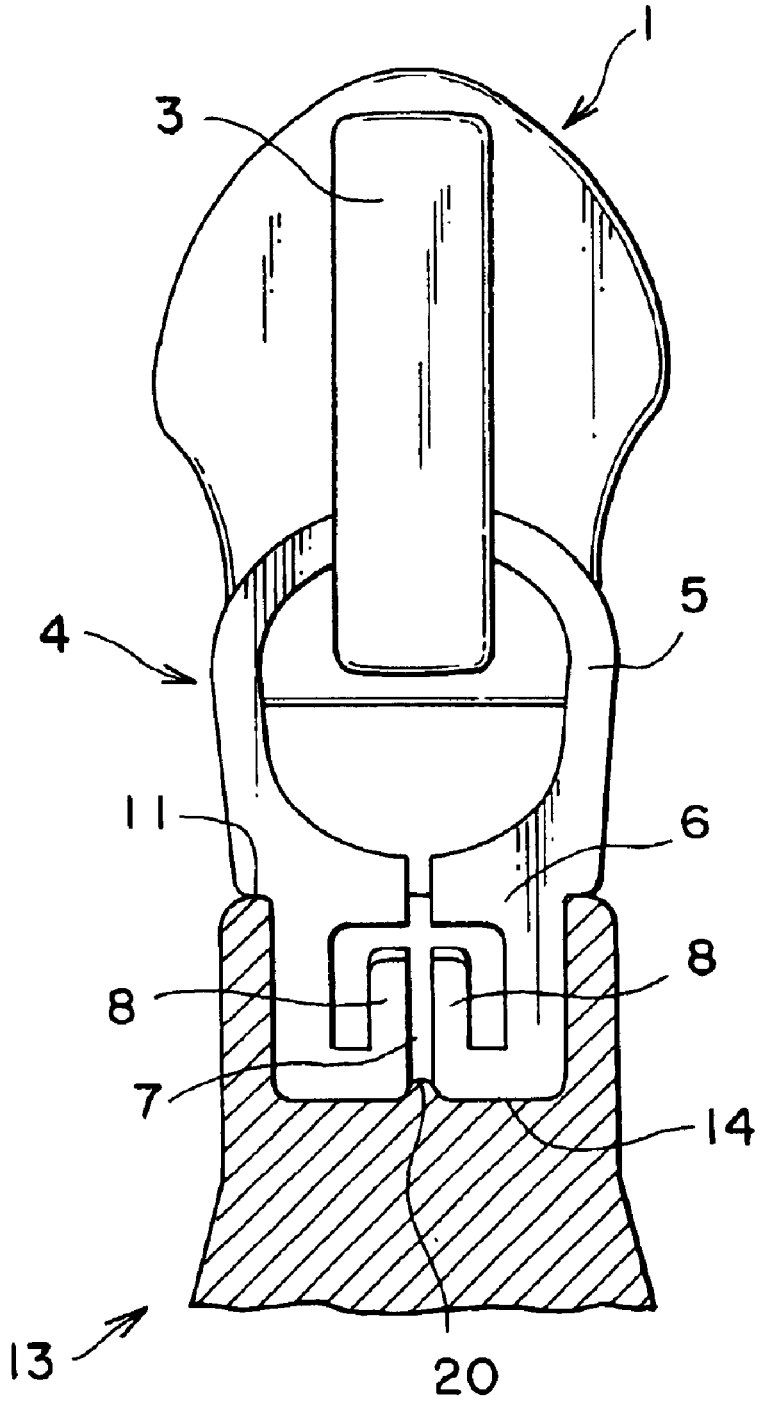
FIG. 7 is a partially broken front view showing a modification of the pull main body in the slider having the pull.
Figure 8:
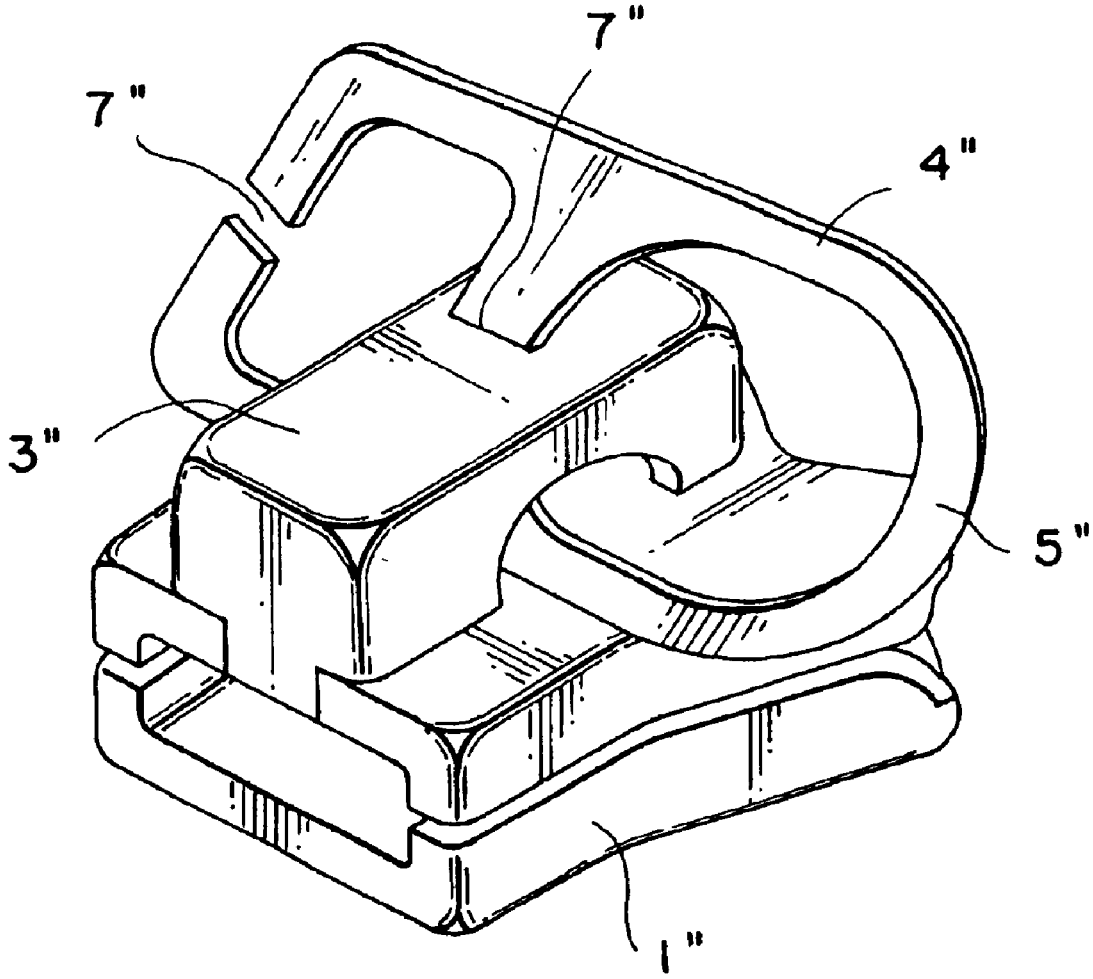
FIG. 8 PRIOR ART
FIG. 8 is a perspective view of a well-known pull of a slider for a slide fastener.

Finally, the third embodiment shown in FIG. 7 will be described. FIG. 7 shows a modification of the accommodating portion 14 of the pull main body 13, which accommodates the attachment plate 6 of the connecting body 4. The configuration of the accommodating portion 14 is substantially the same as the first embodiment, but its different configuration is that a protrusion 20 equal in size to the slit 7 provided on the attachment plate 6 is formed in a center of the bottom of the accommodating portion 14 such that it is protruded toward the opening 15 side. When the attachment plate 6 is inserted, the slit 7 provided in the attachment plate 6 is fitted into this protrusion 20 and consequently, no play occurs relative to the attachment plate 6, thereby achieving stabilized connection.

What is claimed is:

1. A pull of a slider for a slide fastener, wherein the pull comprises a connecting body and a pull main body to be connected with the connecting body, the connecting body has a pull connecting ring with an attachment plate formed integrally with a part of the pull connecting ring, a slit is provided so as to communicate with the pull connecting ring and the attachment plate with dividing the attachment plate, an elastically deformable engaging portion is provided on the attachment plate and the pull main body is provided with an accommodating portion for accommodating the attachment plate and a holding portion for automatically holding the engaging portion using elasticity of the engaging portion.

2. The pull of a slider for a slide fastener according to claim 1, wherein engaging portions each provided on the attachment plate are disposed on both sides of the slit.

3. The pull of a slider for a slide fastener according to claim 1, wherein engaging portions each provided on the attachment plate are provided on both side edges of the attachment plate.

4. The pull of a slider for a slide fastener according to claim 1, wherein the holding portion provided on the pull main body has a through hole or a concave groove provided in the accommodating portion.

5. The pull of a slider for a slide fastener according to claim 1, wherein the slit provided in the attachment plate is formed in a center of the attachment plate.

6. The pull of a slider for a slide fastener according to claim 1, wherein the accommodating portion provided in the pull main body includes a protrusion into which the slit of the attachment plate is fitted, the protrusion being provided on a bottom of the accommodating portion.

7. The pull of a slider for a slide fastener according to claim 1, wherein the engaging portion provided on the attachment plate comprises an engaging lingulated piece having a base portion connected to the attachment plate and a free end portion protruded from a face of the attachment plate.

8. The pull of a slider for a slide fastener according to claim 1, wherein the attachment plate has stepped portions at both sides thereof, the pull main body has an opening, which leads to the accommodating portion, and the stepped portion and side edge portions of the opening oppose each other.

9. A pull of a slider for a slide fastener, wherein the pull comprises a connecting body and a pull main body to be connected with the connecting body, the connecting body has a pull connecting ring with an attachment plate formed integrally with a part of the pull connecting ring, a slit is provided so as to communicate with the pull connecting ring and the attachment plate with dividing the attachment plate, an engaging portion is provided on the attachment plate and the pull main body is provided with an accommodating portion for accommodating the attachment plate and a holding portion for holding the engaging portion;

wherein the holding portion provided on the pull main body has a through hole or a concave groove provided in the accommodating portion.

10. A pull of a slider for a slide fastener, wherein the pull comprises a connecting body and a pull main body to be connected with the connecting body, the connecting body has a pull connecting ring with an attachment plate formed integrally with a part of the pull connecting ring, a slit is provided so as to communicate with the pull connecting ring and the attachment plate with dividing the attachment plate, an engaging portion is provided on the attachment plate and the pull main body is provided with an accommodating portion for accommodating the attachment plate and a holding portion for holding the engaging portion;

wherein the engaging portion provided on the attachment plate comprises an engaging lingulated piece having a base portion connected to the attachment plate and a free end portion protruded from a face of the attachment plate.

11. A pull of a slider for a slide fastener, wherein the pull comprises a connecting body and a pull main body to be connected with the connecting body, the connecting body has a pull connecting ring with an attachment plate formed integrally with a part of the pull connecting ring, a slit is provided so as to communicate with the pull connecting ring and the attachment plate with dividing the attachment plate, an engaging portion is provided on the attachment plate and the pull main body is provided with an accommodating portion for accommodating the attachment plate and a holding portion for holding the engaging portion;

wherein the attachment plate has stepped portions at both sides thereof, the pull main body has an opening, which leads to the accommodating portion, and the stepped portions and side edge portions of the opening oppose each other.

* * * * *